US005775688A

United States Patent [19]

Kato et al.

[11] Patent Number: 5,775,688

[45] Date of Patent: Jul. 7, 1998

[54] PAPER FEED DEVICE

[75] Inventors: Hiroyuki Kato; Takatoshi Takemoto, both of Nagoya, Japan

[73] Assignee: Brother Kogyo Kabushiki Kaisha, Nagoya, Japan

[21] Appl. No.: 773,286

[22] Filed: Dec. 24, 1996

[30] Foreign Application Priority Data

Dec. 26, 1995 [JP] Japan ..... 7-351794

[51] Int. Cl.[6] ..... B65H 3/06

[52] U.S. Cl. ..... 271/167; 400/629; 271/161

[58] Field of Search ..... 400/629; 271/121, 271/124, 167, 161

[56] References Cited

U.S. PATENT DOCUMENTS

| | | | |
|---|---|---|---|
| 3,151,863 | 10/1964 | Lohr | 271/121 |
| 4,113,244 | 9/1978 | Ruenzi | 271/121 |
| 5,181,708 | 1/1993 | Ruch | 271/121 |
| 5,437,444 | 8/1995 | Kawakami et al. | 271/121 |
| 5,527,029 | 6/1996 | Bortolotti et al. | 271/124 |

FOREIGN PATENT DOCUMENTS

| | | | |
|---|---|---|---|
| 58-144027 | 8/1983 | Japan | 271/157 |
| 1-60529 | 3/1989 | Japan | 271/124 |
| U-2-40738 | 3/1990 | Japan . | |
| Y-2-7-29069 | 7/1995 | Japan . | |

*Primary Examiner*—Edgar S. Burr
*Assistant Examiner*—Daniel J. Colilla
*Attorney, Agent, or Firm*—Oliff & Berridge, PLC

[57] ABSTRACT

A paper feed device that uses a separating pawl for preventing overlapped feeding of sheets of recording paper wherein the separating pawl does not resist the feed of paper, thereby ensuring smooth paper feed. In the paper feed device, a sheet of paper is fed from a hopper and moved along a separating tilt plane to be separated from the stacked paper by the separating pawl which is pressed toward the paper path by a spring. Each separate sheet of paper is fed between a paper guide plane and an arm section to a print head by a feed roller and a follower roller. When a paper supply roller is in a stopped state, the sheet of recording paper is pulled by the feed roller to be straightened between a collar member and the paper guide plane such that the sheet of paper is away from the separating pawl and therefore is not affected by the resistance of the separating pawl, ensuring a smooth feed.

25 Claims, 6 Drawing Sheets

PAPER FEED DEVICE

BACKGROUND OF THE INVENTION

1. Field of the Invention

The invention relates to a paper feed device for feeding a plurality of paper stacked in a hopper one by one to a feeding direction by a paper supply roller.

2. Description of Related Art

An automatic paper supply device is known, as disclosed in Japanese Unexamined Utility Model Publication No. 2-40738 (1990) for example, which comprises a paper stacking section having a pushup plate, a paper supply roller for feeding paper stacked in the paper stacking section by rotational operation, and a pressing member for pushing up the pushup plate to press paper against the paper supply roller. In this structure, a separating pawl is arranged vertical to the supply direction of the paper stacked in the paper stacking section such that the upper edge thereof is slightly higher than the lower end edge of the paper supply roller. In automatic paper supply devices having such a separating pawl, paper is fed from the paper stacking section by the paper supply roller, in which the separating pawl touches the fed-out paper to separate the paper from the stacked paper, thereby preventing the paper from being fed in an overlapped manner.

However, in the paper feed device having the above-described structure, the overlapped feeding is prevented by touching of the paper by the separating pawl. Therefore, after a sheet of paper is fed from the paper stacking section by the paper supply roller, the separating pawl may be in contact with the paper to be fed by feed means for printing or the like. If the separating pawl is in contact with the paper during feed, the separating pawl pushes up the paper by elasticity while the paper pushes down the separating pawl during feed by the feed means to produce resistance therebetween, thereby impairing smooth feeding of the paper.

U.S. Pat. No. 5,527,029 discloses leaf springs or spring loaded levers fastened to a side of the supply tray. However, the leaf springs or spring loaded levers provide a strong resistance to paper fed from the tray.

SUMMARY OF THE INVENTION

In view of the above, it is therefore an object of the invention to provide a paper feed device using a separating pawl for preventing paper from being fed in an overlapped manner in which the separating pawl does not produce resistance in feeding paper, thereby realizing smooth paper feeding.

In carrying out the invention and according to one aspect thereof, there is provided a paper feed device comprising a hopper for accommodating a plurality of paper in a stacked matter; a paper supply roller for supplying the paper from the hopper; a separating pawl is arranged near a rim downstream in the feed direction of the plurality of paper accommodated in the hopper and is always pressed against the paper side, the separating pawl standing above the top surface of the paper stack; and feed means for feeding the paper supplied by the paper supply roller downstream in the paper feed direction, wherein a separating tilt plane is arranged as to tilt toward the feed means from a position near the rim downstream in the feed direction of the plurality of paper accommodated in the hopper and the separating pawl is adapted to cross the tilt plane in up and down directions and is always pressed against the direction of protruding from the tilt plane.

Since the separating pawl is structured to go over and below the separating tilt plane and is always pressed toward the direction of protruding from the tilt plane, the uppermost paper in the hopper can be readily delivered from the hopper with the cooperation between the separating pawl and the separating tilt plane, to be fed one by one by the paper supply roller.

Because the separating pawl is structured to go over the separating tilt plane and below the same, the separating pawl is pressed by the paper up to the same level as the separating tilt plane if the separating pawl comes in contact with the paper, thereby preventing the paper from being resisted by the separating pawl for smooth feeding of paper.

The separating pawl may be arranged so as to be located below the paper passing between the hopper and the feed means at the time of paper feed and to form a gap between the separating pawl and the paper. Namely, the separating pawl is arranged so as to be positioned slightly away from a paper feed path between the hopper and the feed means during paper feeding. This novel structure allows the paper fed by the paper supply roller to be separated from each other, the separated paper being further fed downstream one by one. Because the separating pawl is arranged slightly away from the paper feed path between the hopper and the feed means, the separating pawl only slightly touches the paper, so that little frictional resistance is given to the feed of the paper.

The separating pawl may be structured so as not to come into contact with the paper at all or so as to touch the paper so slightly that little frictional resistance is produced during paper feed. Further, the separating pawl is pressed by a spring. It is sufficient for a spring pressing force to be set to a degree at which the separating pawl comes to generally the same level as the separating tilt plane if the rigidity of the paper is relatively large.

The hopper may be detachably structured and the feed means may be composed of a feed roller for feeding the paper and a paper guide plane extending from the feed roller toward the hopper. According to this novel structure, the separating pawl is arranged below the paper guide plane extending from the feed roller toward the hopper, thereby preventing the paper guide plane from hindering the guidance during the paper feed by the feed roller.

The paper supply roller may have a supply section that comes into contact with the paper and a non-supply section that does not come in contact with the paper and further comprises a collar member for holding a space between the non-supply section and the paper on generally the same axis with the paper supply roller. According to this novel structure, the paper is kept fed by the feed means while the paper is fed by the supply section of the paper supply roller and, when the non-supply section is opposed to the paper, the space between the non-supply section of the paper supply roller and the paper is maintained by the collar member. In addition, although the paper is pressed by the collar member, the paper is not resisted by the collar member because there is the separating pawl at the position slightly away from the feed path between the feed means and the hopper.

A print head for printing the recording paper may be provided downstream in the paper feed direction of the feed means. The print head may be of ink jet type that ejects ink droplets onto the recording paper. This novel structure allows the paper which is generally correctly line-fed to be printed by the print head without resistance, downstream in the paper feed direction of the feed means. Especially, when a print head of ink jet type is used, ink droplets are ejected onto the paper to clearly print the paper that is line-fed generally correctly.

The surface of the separating pawl abutting the paper may be formed into a reverse bank. The separating pawl may be provided as one element or a plurality of elements at the center along the width of the paper. According to this novel structure, it is sufficient for one separating pawl to separate the paper from each other; provision of the separating pawl in plurality of elements performs the paper separation more surely.

The separating pawl is arranged so as to go up and down relative to the separating tilt plane and is always pressed against the protruding direction of the tilt plane, so that cooperation between the separating pawl and the separating tilt plane separates the paper in the hopper without excess force, thereby ensuring feed of the paper sheet by sheet.

The separating pawl is arranged slightly away from the paper feed path between the hopper and the feed means during feed. According to this structure, the separating pawl does not provide resistance to the feeding of paper during feeding, allowing the paper to be fed smoothly.

The separating pawl is arranged below the paper passing from the hopper to the feed means during feeding to form a space with the paper. According to this novel structure, the space is formed between the separating pawl and the paper being fed as mentioned above, so that the separating pawl does not provide resistance to the paper, thereby smoothing the paper feed operation.

The separating pawl is arranged below the paper guide plane extending from the feed roller of the feed means toward the hopper, so that the separating pawl does not come in contact with the paper being guided by the paper guide plane, thereby allowing the paper being fed to be guided by the paper guide plane without being hindered by the separating pawl.

The collar member is provided on generally the same axis as the paper supply roller for maintaining an interval between the non-supply section and the paper, so that the interval between the non-supply section and the paper is surely maintained by the collar member, thereby allowing the feed means to feed the paper without being resisted by the separating pawl.

The print head prints the paper downstream in the paper feed direction of the feed means, so that the paper generally correctly line-fed is printed without being resisted by the separating pawl.

The print head of ink jet type is used to clearly print the paper generally correctly line-fed by ejecting ink droplets onto the paper.

BRIEF DESCRIPTION OF THE DRAWINGS

A preferred embodiment of the invention will be described in detail with reference to the following figures, wherein.

DETAILED DESCRIPTION OF THE PREFERRED EMBODIMENTS

Figure 1:
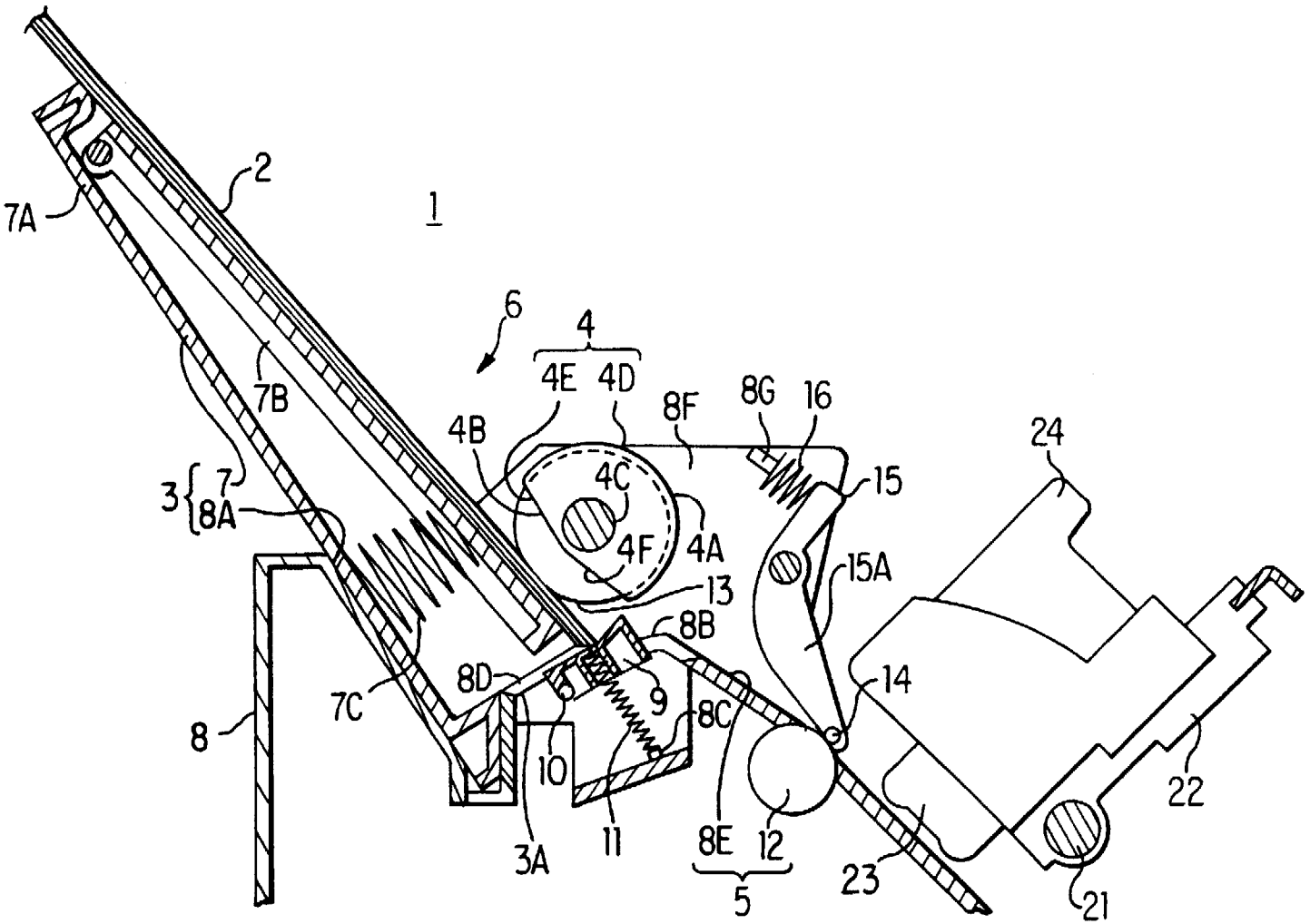
FIG. 1 is a schematic cross sectional view illustrating a paper feed device associated with the invention.

Referring to FIG. 1, there is shown in partial cross-section, a schematic structure of an ink jet printer. The ink jet printer 1 has a paper feed device 6 for feeding a plurality of sheets of recording paper 2 sheet by sheet from a hopper 3, in which the recording paper is stacked, to feed means 5 using a paper supply roller 4 to further feed the recording paper fed downstream in the paper feed direction.

The hopper 3 comprises a paper supply cassette 7 detachably loaded in an engaging recess section 8A of a printer frame 8. The paper supply cassette 7 consists of a box-shaped casing 7A opened at top thereof, a pushup plate 7B rotationally pivoted at the upper end thereof internally to the casing 7A, and a spring 7C between the lower portion of the pushup plate 7B and the casing 7A, that is, always pressing the pushup plate 7B such that the recording paper 2 stacked on the pushup plate is pushed up.

The feed means 5 has a feed roller 12 rotationally supported on the printer frame 8, a follower roller 14 in contact with the feed roller 12, and a paper guide plane BE extending from the feed roller 12 toward the hopper 3 and formed by the printer frame 8.

The printer frame 8 further comprises a separating tilt plane 8B extending upward from the front end of the hopper 3 proximate the rim 3A downstream in the paper feed direction of the recording paper 2 toward the feed means 5. The separating tilt plane 8B integrally continues at the top thereof onto the paper guide plane BE, the planes 8B and 8E forming a paper feed path bent protrudingly between the hopper 3 and the feed roller 12.

The paper supply roller 4 has a supply roller section 4D having, in cross-section, a generally semicircular shape with a circular plane 4A for contacting with the recording paper 2, and a generally triangular non-supply section 4E having planes 4B, 4B not in contact with the recording paper 2. The paper supply roller 4 is structured such that the supply roller section 4D touches the upper surface of the recording paper 2 to supply the recording paper 2 sheet by sheet to the feed roller 12. It should be noted that the arc length of the circular plane 4A of the supply roller section 4D is large enough for the recording paper 2 to reach from the hopper 3 to the feed roller 12.

A collar member 13 is rotationally provided on generally the same axis as the paper supply roller 4 such that the interval between the recording paper 2 and the non-supply section 4E is held so as to not allow the recording paper 2 to touch the non-supply section 4E and the recording paper 2 sheet as further drawn out by the feed roller 12 is supported. Thus, the collar member 13 freely rotates to reduce feed resistance when the recording paper 2 is being fed by the feed roller 12.

The paper supply roller 4 is rotationally pivoted between right and left side plates 8F, 8F of the printer frame 8 via a rotary shaft 4C. The feed roller 12 is rotationally pivoted under the paper supply roller 4 such that the feed roller 12 partially protrudes above the paper guide plane 8E on which the recording paper 2 slides. An eject roller, not shown, is rotationally pivoted downstream of the feed roller 12 to eject the recording paper 2 printed by a print head 23 to be described later.

The follower roller 14 is rotationally pivoted on an arm section 15A at the lower portion thereof of a support member 15, the arm section 15A having a general shape of a "<" and being provided of both side frames 8F, 8F. A spring 16 is provided between the upper portion of the arm section 15A and a spring receiving section 8G of the printer frame 8. The spring 16 always presses the support member 15 to rotate clockwise as shown in FIG. 1, which in turn presses the follower roller 14 against the feed roller 12. The surface of the arm portion 15A facing the paper guide plane 8E provides a guide plane for directing the recording paper 2 toward the rollers 12, 14.

A separating pawl 9 is arranged in front of the engaging recess section 8A and in the proximity of the rim 3A downstream in the feed direction of the recording paper 2. The separating pawl 9 is always pressed against the recording paper 2, when fed, and protrudes above the top of the stack of recording paper 2. Further, the separating pawl 9 is arranged so as to move up and down relative to the separating tilt plane 8B. To be more specific, the separating pawl 9 is provided in one unit at the center of the printer frame 8 relative to the width of the recording paper 2 and rotationally pivoted at the lower portion thereof on a rotary shaft 10. Also, the separating pawl 9 is always pressed by a spring 11 provided between the spring receiving section 8C of the printer frame 8 and the separating pawl 9 in the direction in which the separating pawl 9 protrudes through an opening section 8D of the separating tilt plane 8B.

Figure 3A:
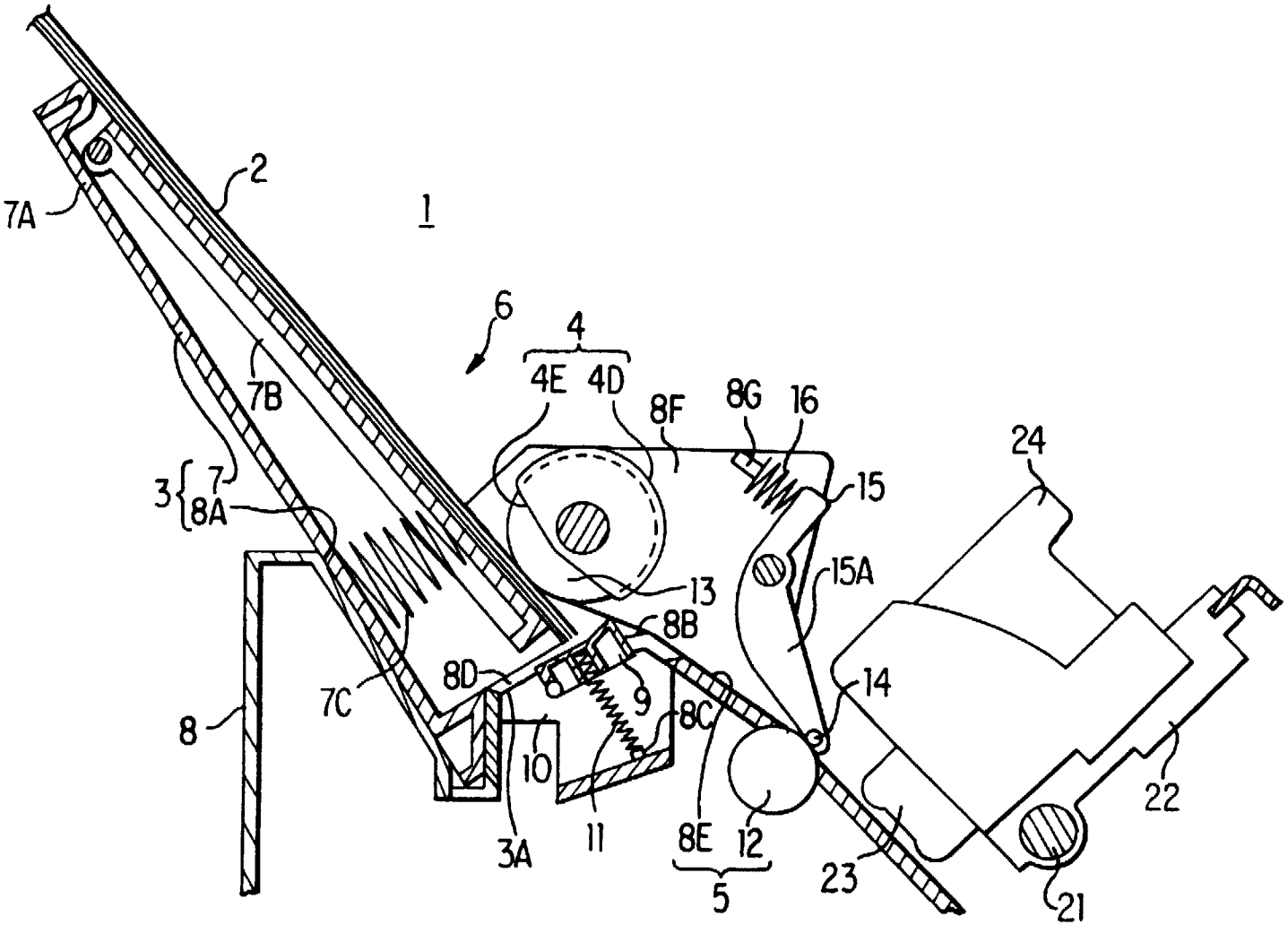
FIG. 3A is a schematic cross sectional view illustrating the operation of the first embodiment of the paper feed device associated with the invention wherein a separating pawl lightly contacts the paper when being fed at a feed roller.
Figure 3B:
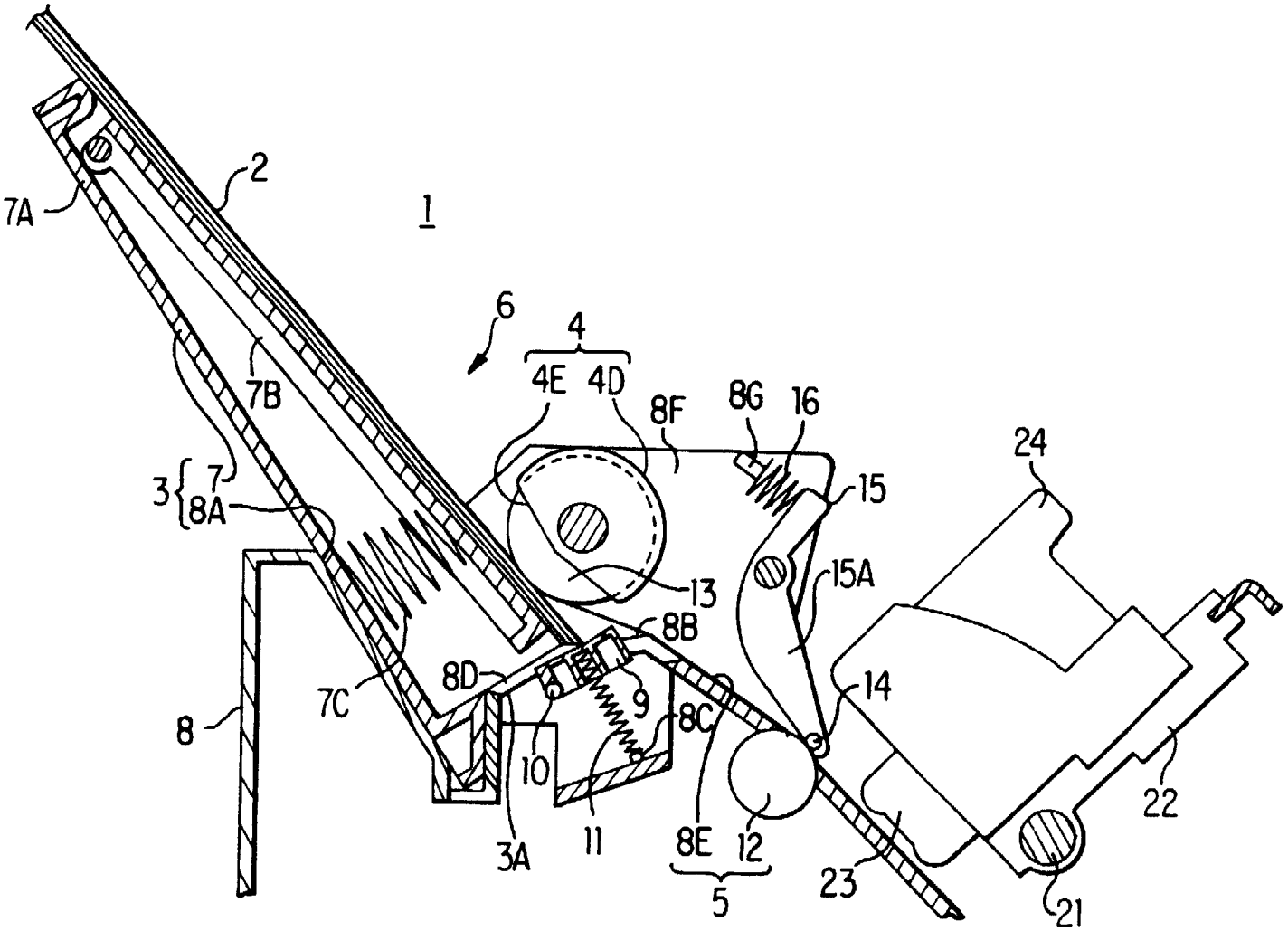
FIG. 3B is a schematic cross sectional view illustrating the operation of a second embodiment of the paper feed device associated with the invention having a shorter separating pawl that does not contact the paper when being fed by the feed roller.

Further, the separating pawl 9 is arranged at a position either to lightly contact the paper in the paper feed path between the hopper 3 and the feed means 5 at the time of paper feed (FIG. 3A) or slightly away from, i.e., does not contact, the paper in the paper feed path between the hopper 3 and the feed means 4 at the time the feed means 5 controls paper feed (FIG. 3B). To be more specific, when the recording paper 2 is pulled from the hopper 3 by the feed roller 12, the separating pawl 9 is beneath and away from the recording paper 2 issuing from the underside of the collar member 13 to the paper guide plane 8E (FIG. 3B) or only touching the recording paper 2 slightly thereby presenting little resistance to the recording paper (FIG. 3A).

Below the feed roller 12, a carriage 22 is reciprocally provided along a guide rail 21, the carriage 22 being provided with a print head 23 of ink jet type and detachably provided with a plurality of ink cartridges 24 containing ink to be supplied to the print head 23. It should be noted that the carriage 22 is driven by such driving means as a carriage motor, not shown, via a timing belt, not shown, for example.

A carriage motor, not shown, is fixedly mounted to the inside of one of the side plates 8F, 8F and is a drive source for selectively driving the feed roller 12 in the forward rotational direction in which the recording paper 2 is fed downstream in the paper feed direction or in the reverse rotational direction in which the recording paper is fed upstream. The outside of one side plate 8F is provided with power transmission gear means, not specifically shown, for transmitting or blocking the rotational drive power of the carriage motor to the rollers 4, 12.

According to the above-mentioned structure, when the paper supply cassette 7 is loaded in the printer frame 8 at the engaging recess section 8A, the recording paper 2 stacked on the pushup plate 7B of the paper supply cassette 7 is pressed against the collar member 13 by the force of the spring 7C pressing the pushup plate 7B, as shown in FIG. 1, so that the leading edge of the recording paper 2 abuts the separating pawl 9 provided on the separating tilt plane 8B.

Figure 2:
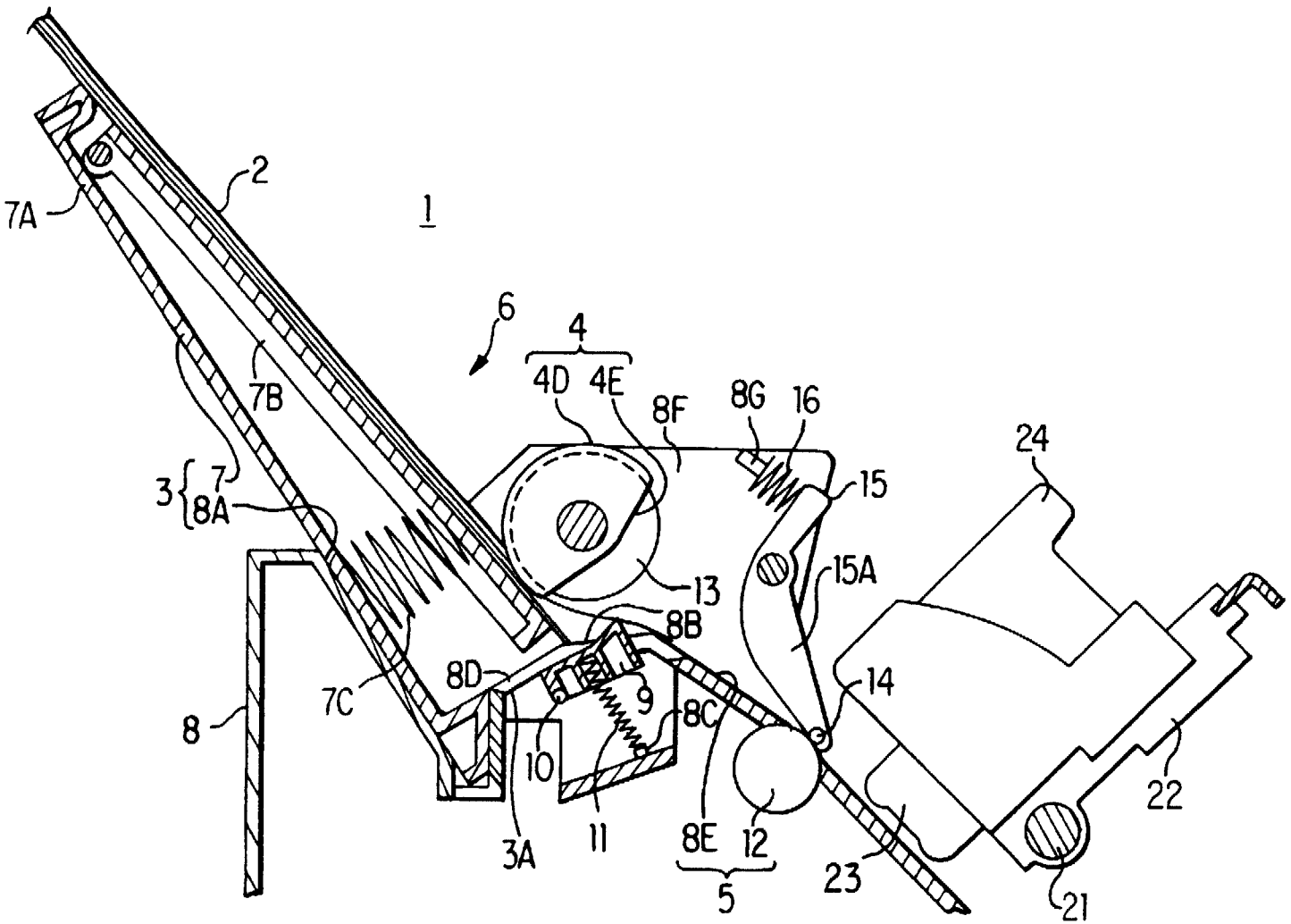
FIG. 2 is a schematic cross-sectional view illustrating the start of operation of the paper feed device associated with the invention.
Figure 4:
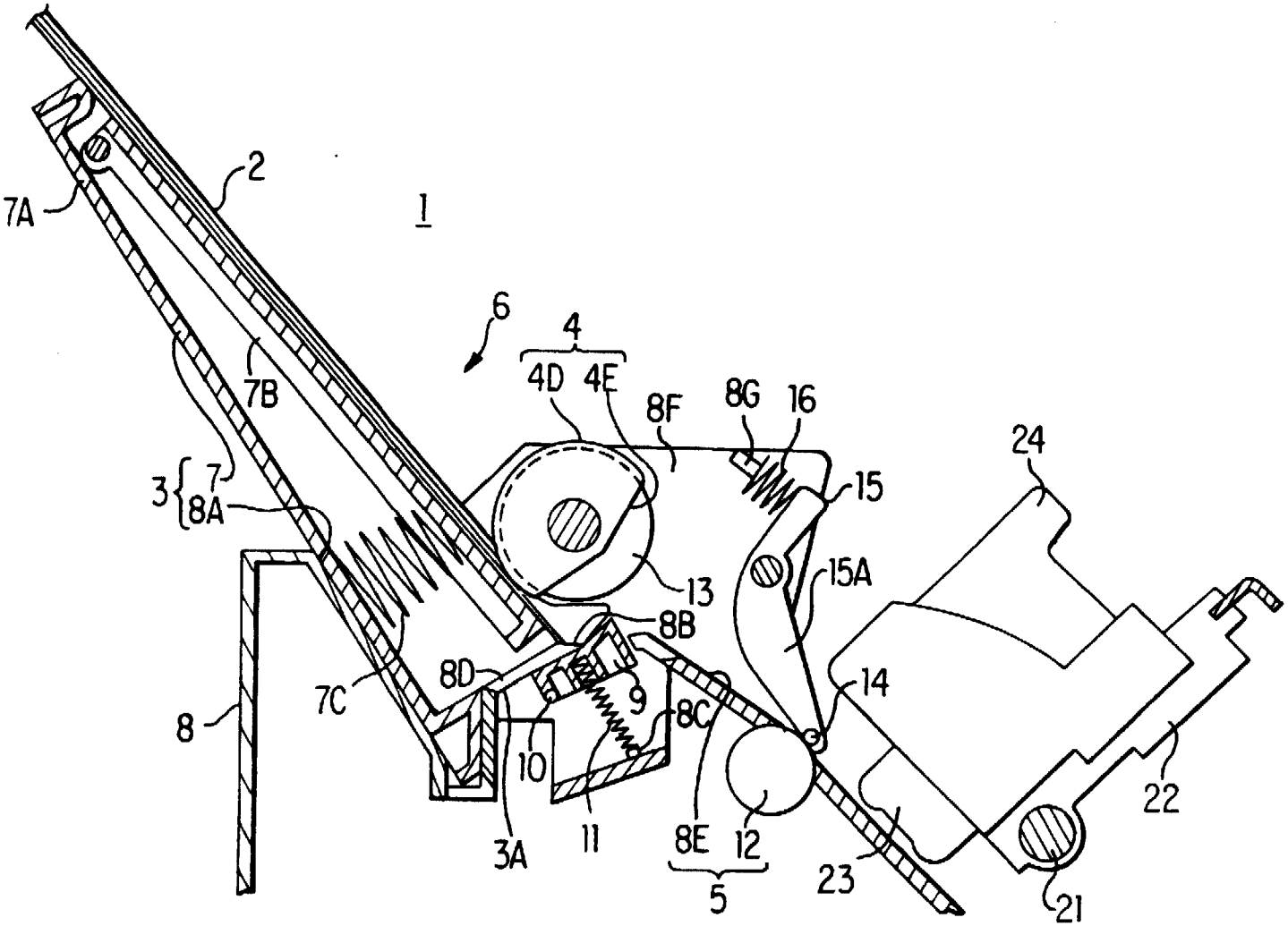
FIG. 4 is still another schematic cross sectional view illustrating operation of the paper feed device associated with the invention.

When a paper supply operation starts, the paper supply roller 4 rotates to make the supply section 4D of the paper supply roller 4 contact the sheet of recording paper 2 on the top of the paper stack, upon which feeding of the recording paper 2 starts. Then, when the leading edge of the sheet of recording paper 2 passes the position at which the separating pawl is located, if the rigidity of the sheet of recording paper 2 is relatively small, or the sheet of recording paper 2 is relatively thin, the sheet of recording paper 2 lightly presses the separating pawl 9 against the force of the spring 11, thereby bending itself as shown in FIG. 4. Subsequently, as shown in FIG. 2, the leading edge of the sheet of recording paper 2 goes over the separating pawl 9 to be separated from the rest of the paper stack.

Figure 5:
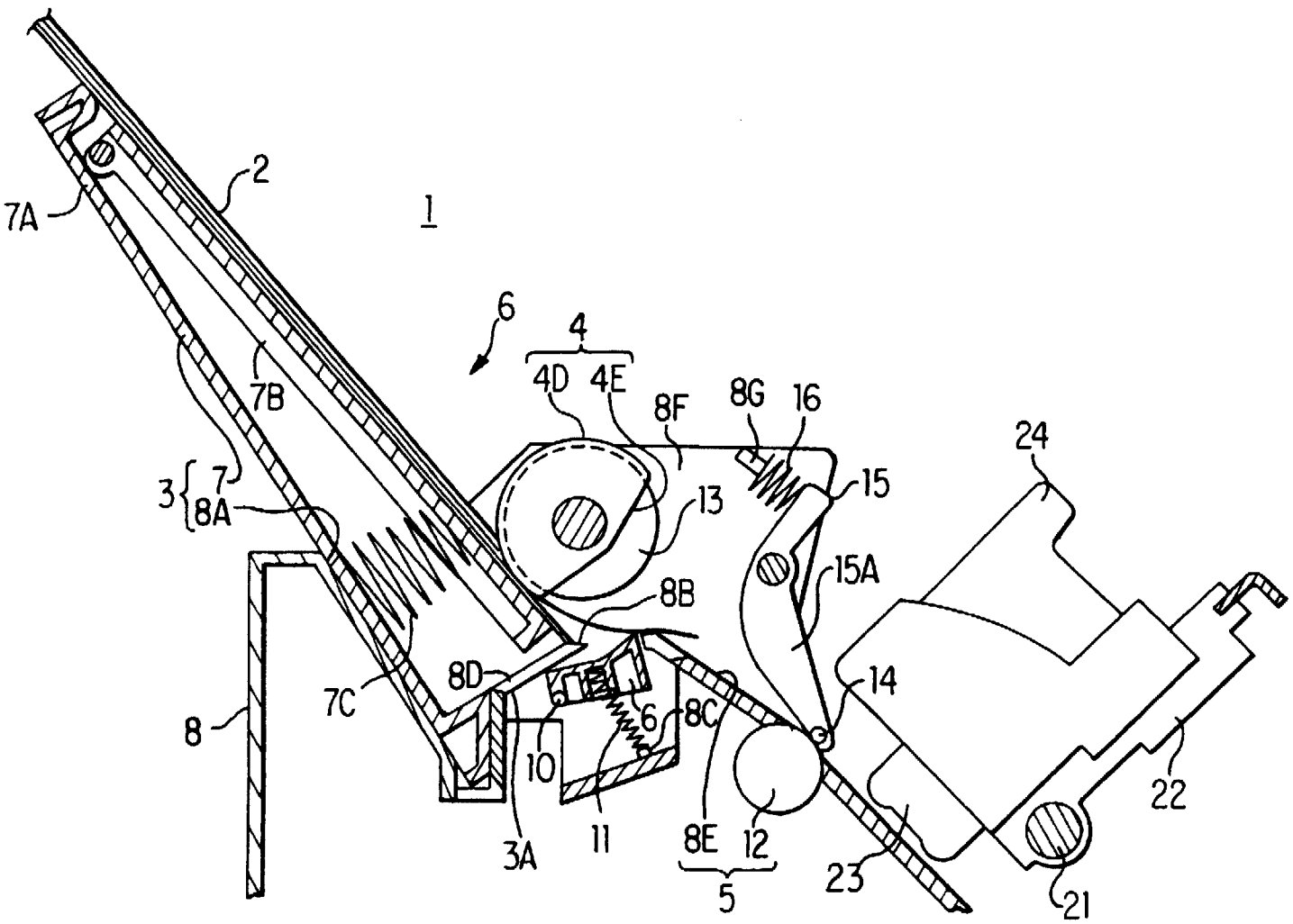
FIG. 5 is yet another schematic cross sectional view illustrating operation of the paper feed device associated with the invention.

On the other hand, if the rigidity of the sheet of recording paper 2 is relatively large, or thick, the sheet of recording paper 2 is gradually separated from the rest of the stack along the separating tilt plane 8B to lower the separating pawl 9 to a level generally flush with the separating tilt plane 8B as shown in FIG. 5. Then, when the leading edge of the sheet of recording paper 2 goes over the tip of the separating pawl 9, the rest of the stack is blocked at the tip of the separating pawl 9 to feed the recording paper 2 sheet by sheet. Thus, regardless of the type of paper, the rest of the stack below the separated sheet of the recording paper 2 remains in the hopper 3 because the separating pawl returns to protrude over the separating tilt plane 8B at a different angle thereto, thereby restricting the rest of the stack from being fed out.

The leading end of the sheet of recording paper 2 rising along the separating tilt plane 8B touches the lower surface of the arm section 15A or is pulled down by its own weight to be fed up to the feed roller 12 in cooperation with the paper guide plane 8E. When the feeding of the sheet of recording paper 2 starts being done or is pulled by the feed roller 12 and the follower roller 14, the feed operation by the paper supply roller 4 stops, upon completion of one rotation, to press the recording paper 2 in the hopper 3 by the collar member 13. Therefore, referring to FIG. 3, the sheet recording paper 2 is pulled by the feed roller 12 and the follower roller 14 to be positioned along the paper guide plane 8E and, at the same time, positioned between the collar member 13 and the top of the separating tilt plane 8B in a straight manner. In this state, the recording paper 2 is opposed, with a slightly negligible gap, to the separating pawl 9 pressed by the spring 11, so that there is no significant contact between the recording paper 2 and the separating pawl 9. Kept in this state, the sheet of recording paper 2 is fed for printing.

Consequently, because the separating pawl 9 is substantially positioned away from the paper feed path between the hopper 3 and the feed means 5 at the time of paper feed, the separating pawl 9 does not come into contact (FIG. 3B) or any significant contact (FIG. 3A) with the sheet of recording paper 2, providing no resistance to the feed of the sheet of recording paper 2 at the time of paper feed for printing. Namely, the separating pawl 9 is positioned below the sheet of recording paper 2 passing from the hopper 3 to the feed means 5 at the time of paper feed and therefore a gap is formed between the sheet of recording paper 2 and the separating pawl 9, thereby giving no resistance to the feed of the sheet of recording paper 2 at the time of paper feed.

Consequently, the sheet of recording paper 2 is line-fed by the feed roller 12 generally correctly to be printed by the print head 23 at a correct pitch. Especially, when high-resolution print by an ink jet head is required, the above-mentioned novel structure provides clear print through the correct pitch.

Further, because the separating pawl 9 goes up and down relative to the separating tilt plane 8B and is always pressed by the spring 11 in the direction in which the separating pawl protrudes above the separating tilt plane 8B, cooperation of the separating function between the separating pawl 9 and the separating tilt plane 8B separates the recording paper 2 stacked in the hopper sheet by sheet without excessive force so a sheet of recording paper 2 is fed toward the feed roller 12. Especially, because the separating pawl 9 is positioned below the paper guide plane 8E, extending from the feed roller 12 toward the hopper 3, the separating pawl 9 does not hinder the paper guiding at the time of paper feed by the feed means 5.

It should be noted that, even if the separating pawl 9 lightly touches the sheet of recording paper 2, as shown in FIG. 3A, located between the collar member 13 and the separating tilt angle 8B in a straight manner, the line-feed pitch of the feed roller 12 is little affected, causing no practical problem. Further, if the separating pawl 9 is separated from the sheet of recording paper, as shown in FIG. 3B, then there can be no effect on the line-feed pitch.

The above-mentioned embodiment uses only one unit of the separating pawl 9. It will be apparent that two or more separating pawls may be used.

While the preferred embodiment of the invention has been described using specific terms, such description is for illustrative purposes only, and it is to be understood that changes and variations may be made without departing from the spirit or scope of the appended claims.

What is claimed is:

1. A paper feed device, comprising:

a hopper having a rim for accommodating a plurality of sheets of paper in a stacked manner;

a paper supply roller for supplying one sheet of paper from the hopper;

a separating pawl which is arranged near the rim of the hopper downstream in the feed direction of the plurality of sheets of paper accommodated in the hopper and resiliently extends toward a paper feed path;

a paper guide plane and a feed member positioned downstream of the paper supply roller in the paper feed direction feeding the paper supplied by the paper supply roller, the paper guide plane offset from the hopper; and a separating plane extending between the paper guide plane and the rim of the hopper to provide the offset between the hopper and the paper guide plane, the separating pawl crosses the separating plane in a substantially transverse direction and is urged in a direction of protruding from the separating plane.

2. The paper feed device according to claim 1, wherein said separating pawl is arranged so as to be positioned to lightly contact the paper in a paper feed path between the hopper and the feed member at the time of paper feed.

3. The paper feed device according to claim 2, wherein the separating pawl is arranged so as to be located below the sheet of paper passing between the hopper and the feed member at the time of paper feed to produce the light contact between the pawl and the sheet of paper.

4. The paper feed device according to claim 3, wherein the light contact of the separating pawl with the sheet of paper gives little frictional resistance to feed of the sheet of paper.

5. The paper feed device according to claim 1, wherein said separating pawl is arranged so as to be spaced from a paper feed path between the hopper and the feed member at the time of paper feed.

6. The paper feed device according to claim 5, wherein the separating pawl is arranged so as to be located below the sheet of paper passing between the hopper and the feed member at the time of paper feed such that the space provides a gap between the separating pawl and the sheet of paper.

7. The paper feed device according to claim 6, wherein said separating pawl does not come into contact with the sheet of paper when the sheet of paper extends along the paper feed path between the hopper and the feed member.

8. The paper feed device according to claim 1, wherein the separating plane extends at an angle greater than 0 degrees from a plane defined by a bottom side of the hopper.

9. The paper feed device according to claim 1, further comprising a spring for urging the separating pawl to protrude from the separating plane.

10. The paper feed device according to claim 9, wherein the pressing force of the spring is set to a degree at which, if the rigidity of the paper is relatively large, the separating pawl retracts to generally the same level as the separating plane.

11. The paper feed device according to claim 1, wherein the hopper is detachable.

12. The paper feed device according to claim 1, wherein the feed member comprises:

a feed roller for feeding the sheet of paper; and a paper guide surface extending from the hopper toward the feed roller.

13. The paper feed device according to claim 1, wherein the paper supply roller has a supply section that comes in contact with the sheet of paper and a non-supply section that does not come in contact with the sheet of paper and further comprises a collar member for maintaining a space between the non-supply section and the paper in the hopper on a same axis as the paper supply roller.

14. The paper feed device according to claim 1, further comprising a print head downstream in the paper feed direction of the feed member for printing the paper.

15. The paper feed device according to claim 14, wherein the print head is of ink jet type that ejects ink droplets onto the sheet of paper.

16. The paper feed device according to claim 1, wherein a surface of the separating pawl abutting the sheet of paper has a sloped upper surface increasing in height toward the separating plane.

17. The paper feed device according to claim 1, wherein the separating pawl is provided at a center of a width of the paper.

18. The paper feed device according to claim 1, wherein the separating pawl comprises a plurality of pawls.

19. A paper feed system for use with a printing apparatus having a paper tray mounted into an opening at a top side of the printing apparatus, a lower end of the paper tray received on an opening section of a frame of the printing apparatus, the paper feed system comprising:

a paper supply roller rotatably mounted in the frame to oppose paper in the paper tray adjacent an end of the paper tray received on the opening section, the paper supply roller having a supply roller section and a non-supply section;

a separating tilt frame extending in a downstream direction, relative to a paper feed path, from the opening section;

a paper guide plane extending at an angle from the separating tilt frame and offset from paper in the paper tray;

a feed roller rotatably mounted in the frame, an outer surface of the feed roller extending through and slightly above a feed path surface of the paper guide plane; and a separating pawl extending through an opening between the opening section and the separating tilt frame, the separating pawl being pivotally mounted to extend toward and move away from the paper feed path and having a first part adjacent the paper in the paper tray and a second part away from the paper in the paper tray, the offset of the paper guide plane from the paper in the paper tray being substantially equal to a length of the separating tilt plane in a feed direction along the paper feed path.

20. The paper feed system according to claim 19, further comprising a pressure member resiliently urging the separating pawl toward the paper feed path.

21. The paper feed system according to claim 19, wherein an upper surface of the separating pawl extending between the first part and the second part has a shape such that a junction with the second part is further removed from a surface of the separating tilt frame than a junction with the first part is from the opening section, the junction with the first part being substantially opposite an end of the paper in the paper tray.

22. The paper feed system according to claim 21, wherein the upper surface of the separating pawl substantially forms an extension of the separating tilt frame across the opening between the opening section and the separating tilt frame when the separating pawl is removed from the paper feed path.

23. The paper feed system according to claim 19, further comprising:

a support member pivotally mounted to the frame;

a follower roller at an end of the support member opposing the feed roller; and a pressing member urging the follower roller against the feed roller.

24. The paper feed system according to claim 23, wherein the supply roller section has an arc length at least as long as a distance from the end of the paper in the paper tray to a nip between the follower roller and the feed roller.

25. The paper feed system according to claim 19, further comprising a collar member in contact with the paper when the non-supply section of the paper supply roller opposes the paper, the collar member freely rotatably mounted to the frame.

* * * * *